US006392204B2

(12) United States Patent
Corda et al.

(10) Patent No.: US 6,392,204 B2
(45) Date of Patent: May 21, 2002

(54) SYSTEM FOR CONTROLLING THE DURATION OF A SELF-CLEAN CYCLE IN AN OVEN

(75) Inventors: Andrea Corda, Luino (IT); Steven T. Baas, Hamilton, OH (US); Anthony T. Jenkins, Lompoc, CA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/901,876

(22) Filed: Jul. 9, 2001

Related U.S. Application Data

(60) Provisional application No. 60/217,817, filed on Jul. 12, 2000.

(51) Int. Cl.[7] ..... A21B 1/40

(52) U.S. Cl. ..... 219/413; 219/391; 219/492

(58) Field of Search ..... 219/391, 393, 219/398, 413, 490, 492, 497, 506

(56) References Cited

U.S. PATENT DOCUMENTS

| | | | | | |
|---|---|---|---|---|---|
| 3,962,561 | A | | 6/1976 | Maitenaz | 219/391 |
| 4,238,670 | A | | 12/1980 | Maitenaz | 219/413 |
| 4,481,404 | A | | 11/1984 | Thomas et al. | 219/398 |
| 4,831,237 | A | | 5/1989 | Gelineau | 219/398 |
| 4,870,238 | A | * | 9/1989 | Hodgetts et al. | 219/506 |
| 4,954,694 | A | | 9/1990 | Nagai et al. | 219/413 |
| 5,286,943 | A | | 2/1994 | Has | 219/413 |
| 5,343,020 | A | | 8/1994 | Waigand et al. | 219/413 |
| 5,386,099 | A | * | 1/1995 | Has | 219/413 |
| 6,232,584 | B1 | * | 5/2001 | Meyer | 219/413 |
| 6,285,290 | B1 | * | 9/2001 | Kouznetsov | 219/393 |

FOREIGN PATENT DOCUMENTS

| | | | |
|---|---|---|---|
| DE | 19606571 | 8/1997 | H05B/1/02 |
| EP | 0308733 | 8/1990 | F24C/7/00 |

* cited by examiner

*Primary Examiner*—Joseph Pelham
(74) *Attorney, Agent, or Firm*—Joel M. Van Winkle; Robert O. Rice; Thomas J. Roth

(57) ABSTRACT

An oven capable of being operated in a self-cleaning cycle wherein the time period of the self clean cycle is responsive to the amount of soil accumulation in the oven. The oven includes a cooking chamber, a heating device for supplying heat into the cooking chamber and an exhaust flue extending from the cooking chamber leading to atmosphere. A heat control device is provided for controlling the operation of the heating device and an input device is used for signaling the heat control device to initiate the self-cleaning cycle. A gas sensor communicates with the exhaust flue for measuring a concentration of a gas component produced from combustion of food soils within the cooking chamber. The gas sensor has a signal output indicative of the measured concentration of the gas component during the self-cleaning cycle. The heat control device receives successive gas concentration signals from the gas sensor and calculates a gas concentration versus time curve. The heat control further calculates a gas concentration area representing the area under the gas concentration curve, and terminates the self-cleaning cycle in correspondence with the gas concentration area. The heat control device may further determine the peak gas concentration or the slope of the gas concentration curve for a period of time and terminate the self cleaning cycle in correspondence with the calculated gas concentration area and the peak gas concentration value and/or the calculated slope value.

15 Claims, 8 Drawing Sheets

SYSTEM FOR CONTROLLING THE DURATION OF A SELF-CLEAN CYCLE IN AN OVEN

This application claims benefit of Provisional Appln. No. 60/217,817 filed Jul. 12, 2000.

BACKGROUND OF THE INVENTION

The present invention relates to self-cleaning ovens and in particular, to a system for controlling the operation of a self-cleaning oven.

During the use of an oven of an electric or gas range, deposits will generally accumulate as a result of spills, boil overs and other unintended release of foods from their cooking containers. In order to ease the cleaning of the spillage, provision is made in some ranges, known as "self-cleaning" ranges, to raise the temperature of the cooking cavity well above that which would be used in cooking in order to carbonize or burn out the residue. In general, this is achieved by the selection through the range's controls of a self-clean cycle. Initiation of this cycle typically sets a high control temperature for the range, locks the oven door at some predetermined time or temperature and proceeds to heat the cavity to a relatively high temperature for a predetermined time before ending the cycle, allowing cooling to occur and then releasing the door lock as an end to the cycle.

Typically, the time period set for this self-clean cycle is determined by the assumption of a worst case cycle. During the cycle, odors or even smoke may be released in the range environment and significant energy is used to hold the cooking cavity at a high temperature. Because of odor and smoke release, users are advised to open windows and will frequently leave the kitchen area for an extended period of time while self-clean is performed.

If a method can be devised which adjusts the time of self-cleaning to that needed for the existing degree of soil accumulation, then cycle times and their negative impact on kitchen environment and energy usage can be minimized.

U.S. Pat. No. 4,954,694 discloses a self-cleaning oven which incorporates a heat controlled unit which is responsive to a gas signal from a gas sensor located in the exhaust passage. The gas sensor measures humidity or carbon dioxide levels. The heat control samples the gas signal at a given time interval to detect a variation of amount of the gas component and detect a first inflection point from decreasing to increasing or visa versa in a gas-component variation and a second inflection point from decreasing to increasing or vice versa in the gas component variation after detection of the first inflection point. The heat control means determines the heating time period for cleaning in correspondence with the second inflection point. An oxidizing catalyst is provided in the exhaust passage, upstream of the gas sensor.

SUMMARY OF THE INVENTION

The present invention is directed to an oven capable of being operated in a self-cleaning, cycle wherein the time period of the self clean cycle is responsive to the amount of soil accumulation in the oven. The oven includes a cooking chamber, a heating device for supplying heat into the cooking chamber and an exhaust flue extending from the cooking chamber leading to atmosphere. A heat control device is provided for controlling the operation of the heating device and an input device is used for signaling the heat control device to initiate the self-cleaning cycle. A gas sensor communicates with the exhaust flue for measuring a concentration of a gas component produced from combustion of food soils within the cooking chamber. The gas sensor has a signal output indicative of the measured concentration of the gas component during the self-cleaning cycle. The heat control device receives successive gas concentration signals from the gas sensor and calculates a gas concentration versus time curve. The heat control further calculates a gas concentration area representing the area under the gas concentration curve, and terminates the self-cleaning cycle in correspondence with the gas concentration area.

The heat control device may further determine the peak gas concentration and/or the slope of the gas concentration curve for a period of time. The self clean cycle may then be terminated in response to the calculated gas concentration area and the peak gas concentration value and/or the calculated slope value.

The present invention is also directed to a method of controlling the self-cleaning of a cooking oven cavity having an exhaust flue. The method includes the step of heating the interior of the oven cavity to a pyrolyzing temperature greater than 800° F. The concentration of a gas component produced from combustion of food soils within the oven cavity is measured by receiving successive gas concentration signals from a gas sensor communicating with the exhaust flue. A gas concentration versus time curve is calculated and a gas concentration area representing the area under the gas concentration curve is also calculated. Heating of the oven cavity is terminated after a determined time which is correlated to the gas concentration area.

DETAILED DESCRIPTION OF THE PREFERRED EMBODIMENTS

Figure 1:
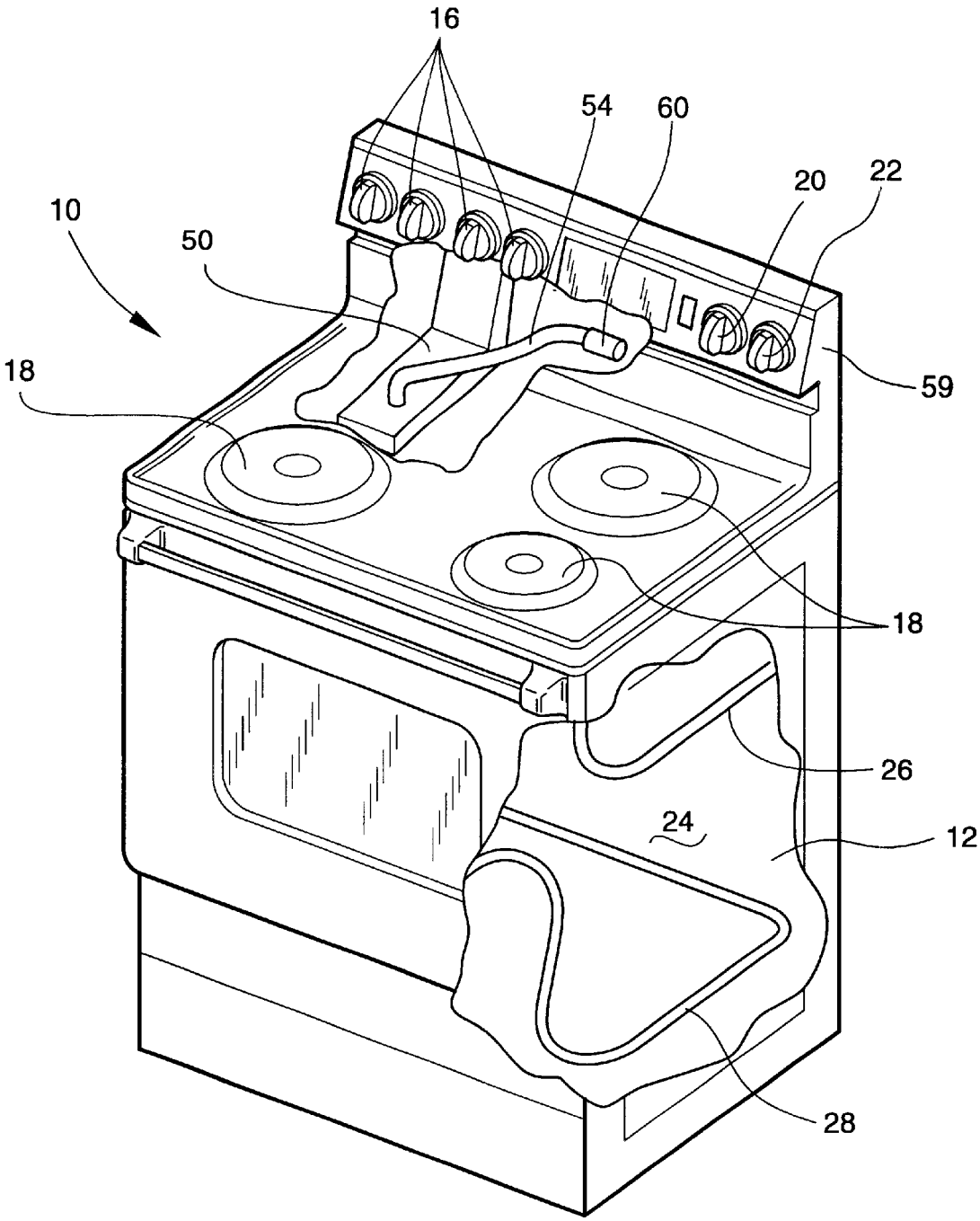
FIG. 1 is a perspective view of an oven embodying the principles of the present invention.
Figure 2:
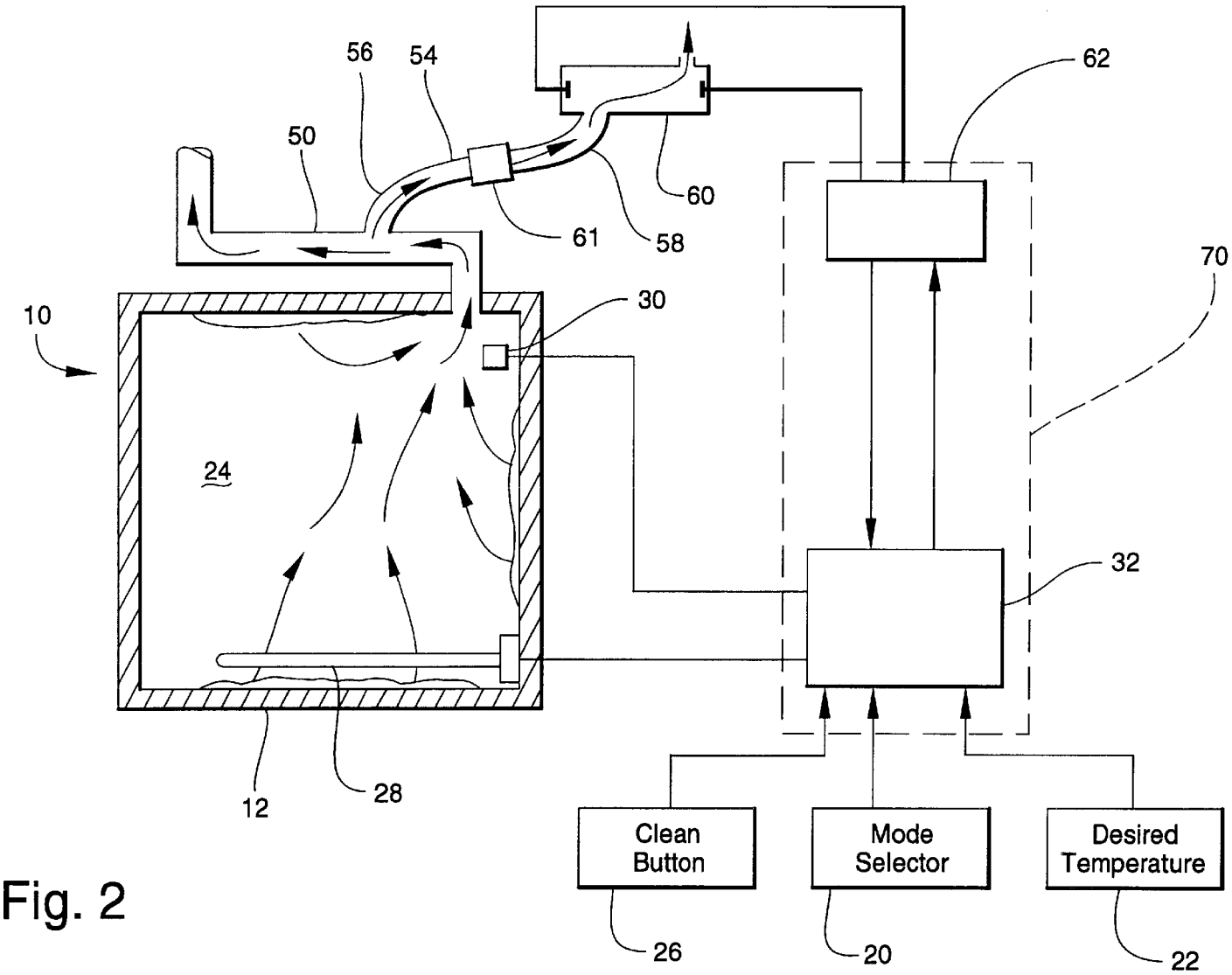
FIG. 2 is a schematic side section of an oven incorporating the principles of the present invention.

FIGS. 1 and 2 illustrate an electric range 10 having a self-cleaning oven 12 adapted to be controlled by a microprocessor based control system and a method in accordance with the principles of the present invention. Although an electric range 10 is illustrated, it should be understood that a gas range may implement the features of the present invention.

The range 10 includes a plurality of control knobs 16 for controlling a respective plurality of conventional electric (or gas) burners 18. In addition, the range 10 includes a control knob 20 for controlling a mode of operation of the oven 12. For example, an OFF mode, a bake mode, a broil mode and a clean mode of operation may be selected by the control knob 20. A push button 26 may also be provided to initiate the self clean cycle. In addition, a control knob 22 is conventionally provided to select a desired oven temperature within the oven 12. Disposed within a cavity 24 of the oven 12 is at least one conventional heating element 28. Furthermore, positioned within the cavity 24 of the oven 12 is a conventional temperature sensor 30, such as, for example, a standard oven temperature sensing probe.

The microprocessor based control system includes an electric circuit or microprocessor 32 suitably programmed to effect the desired control of the range 10. The microprocessor 32 may include an analog-to-digital (a/d) converter for receiving analog voltage input signals from, for example, the temperature sensor 30, and for providing digital output pulses or signals to a controller section within the microprocessor 32. Also, conventionally, the microprocessor 32 includes a memory for retaining programmed instructions for operating the control system including a desired oven temperature control algorithm for controlling the temperature of the oven 12, particularly during the clean mode of operation.

The control system may also include a power switching relay (not shown) having a pair of relay contacts for switching power to the heating element 28, from a constant voltage (e.g. 240 volts) source of alternating current electric power under the control of the controller 32. For simplification, only a single element 28 has been illustrated in FIG. 2. In an actual commercial embodiment, however, a broiling element could, of course, be a part of the control system along with its own power switching relay to interconnect the broiling element to the power source.

Above the oven cavity 24 is an exhausting passage or flue passage 50 through which atmosphere within the oven cavity 24 may be exhausted to the ambient atmosphere. In a preferred, although not necessary, arrangement, an outlet tube 54 is provided which communicates at a first inlet end 56 with the flue passage 50 and has a second end 58 which preferably is located in or near a console 59 of the stove on which the various control knobs 16, 20, 22 are mounted. A gas sensor 60 is connected to the second end 58 of the outlet tube 54. With the sensor located in or near the console 59 the sensor will be isolated from the high temperatures of the oven cavity 24.

A filter 61 may be provided in line with the outlet tube 54 to prevent undesired products such as particulate matter or moisture to enter into the gas sensor 60. An activated carbon filter is preferred. Activated carbon is a very porous material capable of adsorbing water vapor. As the sample gas flow passes through the charcoal pellets in the filter 61, it is forced to change direction may times causing the water to separate. This redirection also traps the grease and particulate matter before it reaches the gas sensor 60.

The sensor 60 may be an infrared (IR) type gas sensor wherein infrared light is emitted from an infrared source and directed through a sample chamber to a infrared detector. The sensor 60 is interconnected with a sensor controller 62 for providing readings of selected gas concentration levels. The sensor controller 62, along with the other control components may also be located within the console 59. It can be understood by one skilled in the art that the sensor 60 may be mounted directly to a circuit board which also supports the sensor control 62.

Although the shape and arrangement of the outlet tube 54 can be varied, in a preferred arrangement the outlet tube 54 includes a portion that has a continuous upward slope from its inlet end 56 to its outlet end 58 such that any condensation from gases flowing therein will drip back into the flue passage 50 and will not collect in the outlet tube 54 which might otherwise block the tube 54.

As an alternative mounting arrangement, a gas sensor 60 may be mounted directly in the flue passage 50. However, in these positions the sensor will be subjected to higher temperatures and other products of combustion which may require filtering or shielding to provide some of the functions of the tube 54.

In a preferred arrangement, there is the main controller section 32 and a separate sensor control 64—each being separately mounted printed circuit boards. However, the main controller 32 and the sensor controller 62 may also be combined into single controller. The control system for the range 12 may be generally referred to as a control system 70—shown as a combination of the controller 32 and the sensor controller 62.

As discussed above, the present invention is directed to a system wherein the length of the self-cleaning cycle is adjusted to the length needed for the existing degree of soil accumulation such that the total cleaning cycle time is minimized and the negative impact on kitchen environment and energy usage caused by the cleaning cycle time can be minimized. In general, the necessary clean time is related to the amount of food soils that have accumulated in the oven cavity 24 such that the greater the quantity of soil, the greater the amount of clean time is required.

Figure 3:
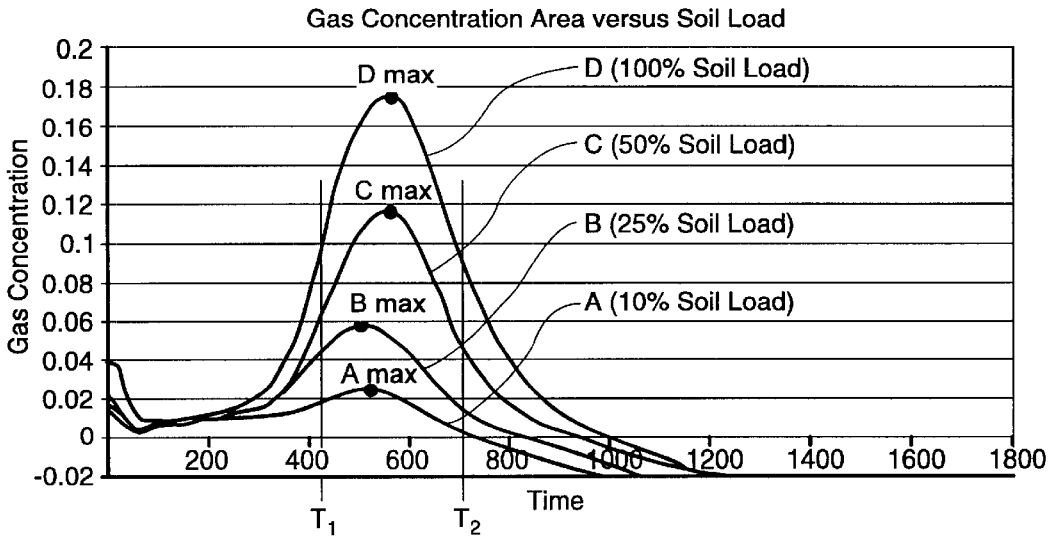
FIG. 3 is a graphic illustration for describing gas concentration level versus time curves which occur during a clean cycle for different soil loads in the oven.

FIG. 3 illustrates graphically gas concentration for gases produced by food soil combustion vs. time for different amounts of soil load. As can be seen, for a light soil load as represented by curve A, the gas concentration increases slightly to a maximum point $A_{max}$ and then decreases to reach a final or end value close zero. (For reference purposes, the soil load represented by curve A may be considered to be 10% of a standardized soil load such as may be used by a testing organization such as Consumers Union.) As the amount of soils in the oven cavity 24 increases, as shown by curves B and C, representing increasing soil loads (25% and 50% soil loads, respectively), the gas concentration increases to a maximum valve of $B_{max}$ and $C_{max}$, respectively, and then decreases to reach a final or end value close to zero. Curve D represents a heavy load (100% soil load) wherein the gas concentration increases slightly to a maximum point $D_{max}$ and then decreases to reach a final or end value close zero.

It can be understood that the gas concentration curves represent a sort of signature corresponding to the quantity of soils that are in the oven cavity prior to the initiation of the self clean cycle. By measuring and evaluating various characteristics of this signature, information regarding the soil load and the appropriate self clean cycle duration can be gathered.

Figure 4:
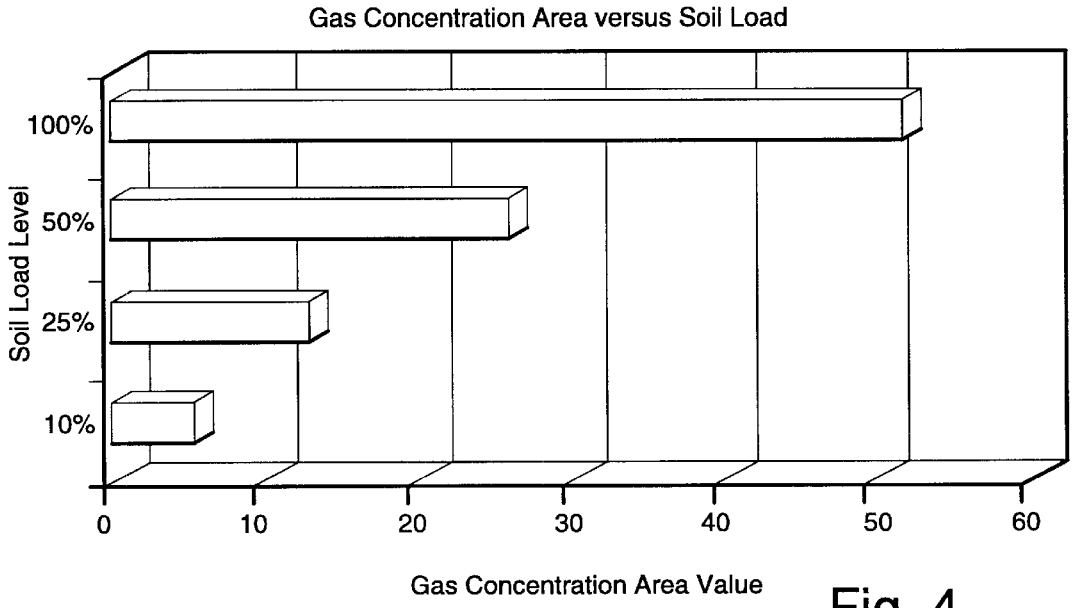
FIG. 4 is a chart illustrating the gas concentration area for different soil load levels.

One feature of the gas concentration signature that can be used to control the duration of a self clean cycle is the area under the gas concentration curve—the gas concentration area. As FIG. 3 illustrates, the gas concentration curve for each soil level differs. In particular, the gas concentration area in an optimized time range, such as between time $T_1$ and $T_2$, differs dependent on the soil level. FIG. 4 illustrates the gas concentration area for different soil loads. For the soil load level represented by curve A, the area value is relatively small. For the soil loads represented by the curves B and C, the area values increase in value, corresponding to the increased soil load. Finally, the area value for a heavy soil load such as represented by curve D, is relatively large.

Figure 5:
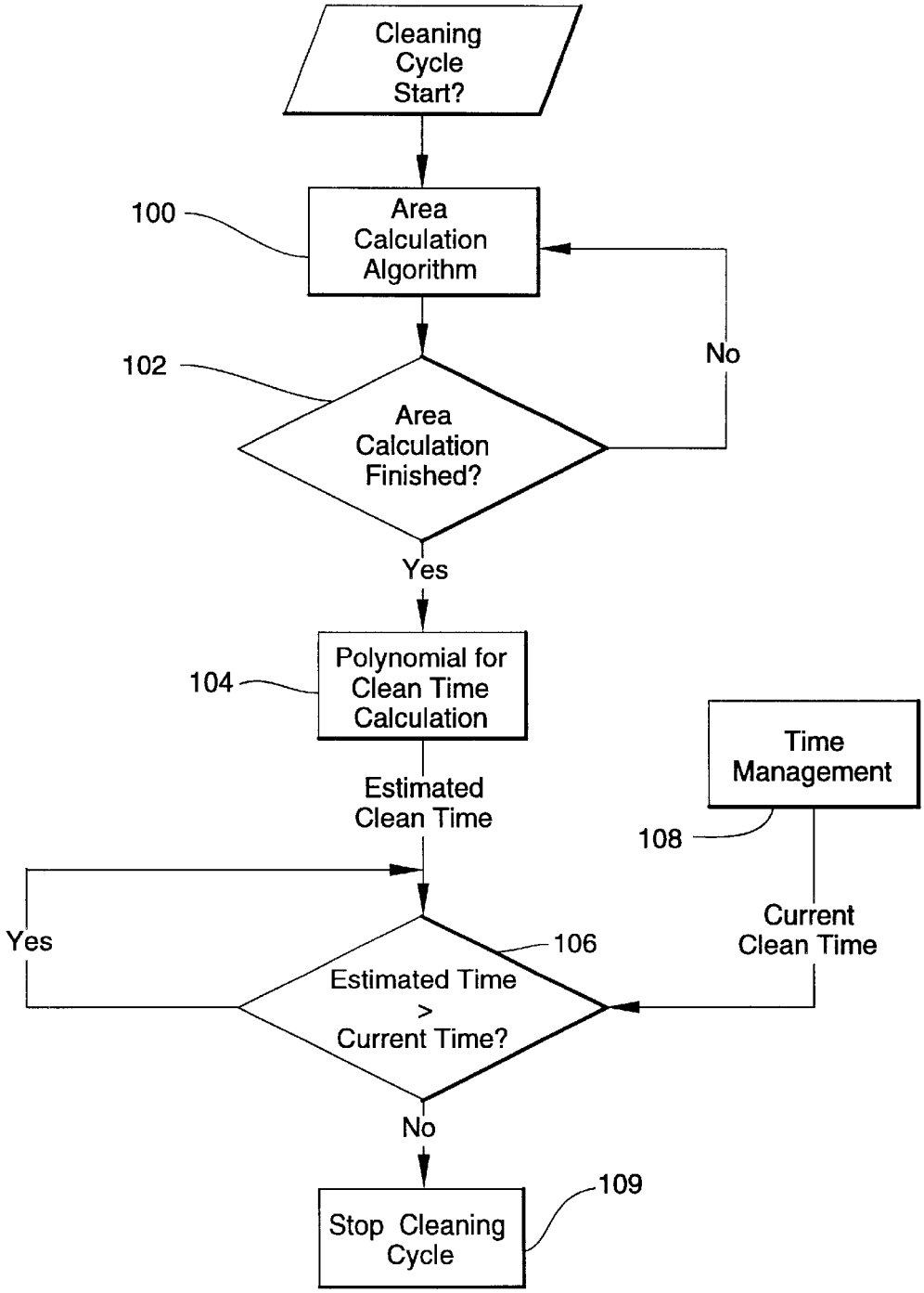
FIG. 5 is a flow chart for describing the oven cavity cleaning time logic used in the present invention.

It can be seen, therefore, that the gas concentration area is a relatively good measure of the amount of food soils which have accumulated in the oven cavity. Accordingly, this information may be used to control the length of the cleaning cycle. FIG. 5 is a flow chart illustrating the control operations of the present invention. After a clean cycle is selected, through an appropriate mode selector such as a knob or push button, the heating element 28 is energized to heat the oven cavity 24 to the appropriate clean temperature. The gas concentration area is then calculated, as shown in steps 100 and 102, for an optimized period of time—such as between time $T_1$ and $T_2$. Once the gas concentration area calculation is complete, the clean time is calculated as shown in step 104. The clean time is determined in accord with the following mathematical function:

$$\text{Cleantime}=\psi(\text{gas concentration area})$$

where $\psi$ is a mathematical function defined empirically via experiments.

The oven is then operated in a clean mode for the cleantime value calculated in step 104, as shown in steps 106 and 108. The clean cycle is terminated in step 109, after the calculated clean time has elapsed.

Figure 6:
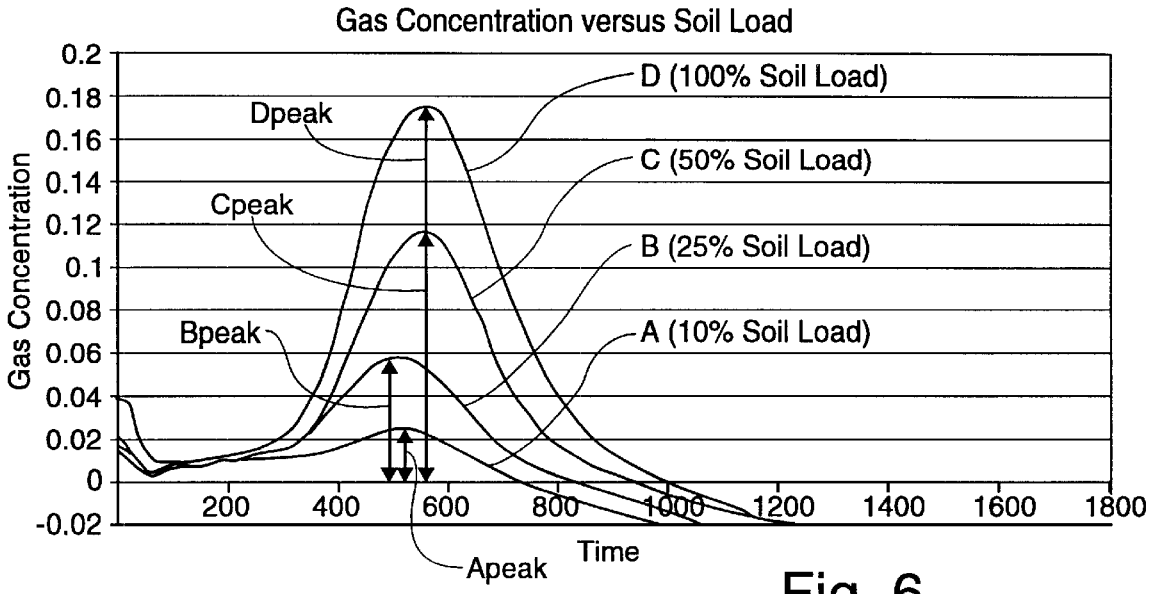
FIG. 6 is a graphic illustration for describing gas concentration level versus time curves which occur during a clean cycle for different soil loads in the oven and identifying the peak concentration points for the different curves.
Figure 7:
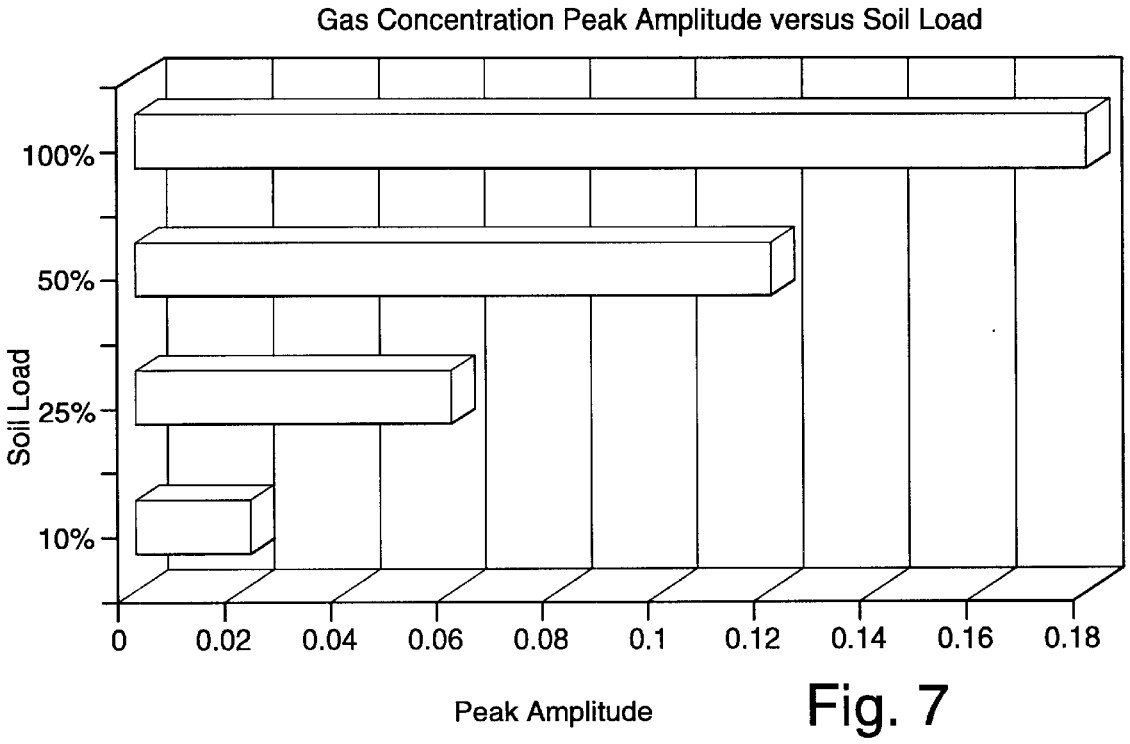
FIG. 7 is a chart illustrating the peak concentration values for different soil load levels.

Another characteristic of the gas concentration curve that can be used to measure the degree of soiling in an oven is the maximum concentration value. FIG. 6 illustrates the different maximum or peak concentrations, $A_{peak}$, $B_{peak}$, $C_{peak}$, $D_{peak}$, for the curves A, B, C and D, respectively. FIG. 7 illustrates the relationship between the peak concentration values and the soil load levels. The greater peak concentration values correspond to the greater soil loads.

Figure 8:
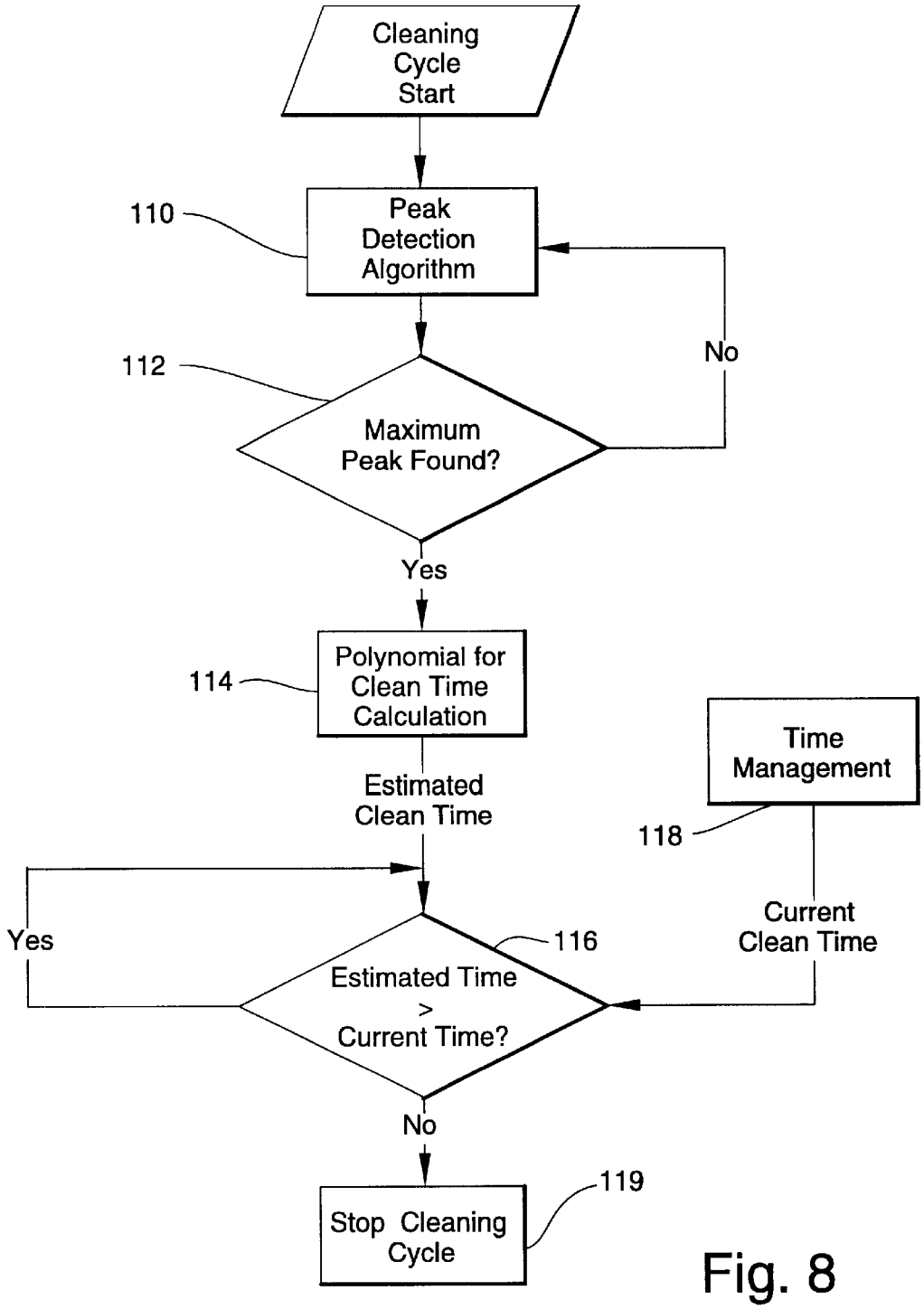
FIG. 8 is a flow chart for describing the oven cavity cleaning time logic which may be used in the present invention.

It can be seen, therefore, that the peak concentration values are a relatively good measure of the amount of food soils which have accumulated in the oven cavity. The greater the peak concentration values, the greater the soil load and the longer the self clean cycle must be to adequately clean the oven. Accordingly, this information may be used to control the length of the cleaning cycle. FIG. 8 is a flow chart illustrating how this information may be used to control the duration of a self clean cycle. After a clean cycle is selected, through an appropriate mode selector such as a knob or push button, the heating element 28 is energized to heat the oven cavity 24 to the appropriate clean temperature. The peak gas concentration value is then determined, as shown in steps 110 and 112. Once the peak concentration value has been measured, the clean time may be calculated as shown in step 114. The clean time is determined in accord with the following mathematical function:

$$\text{Cleantime}=\psi(\text{peak gas concentration value})$$

where $\psi$ is a mathematical function defined empirically via experiments.

The oven is then operated in a clean mode for the cleantime value calculated in step 114, as shown in steps 116 and 118. The clean cycle is terminated in step 119, after the calculated clean time has elapsed.

Figure 9:
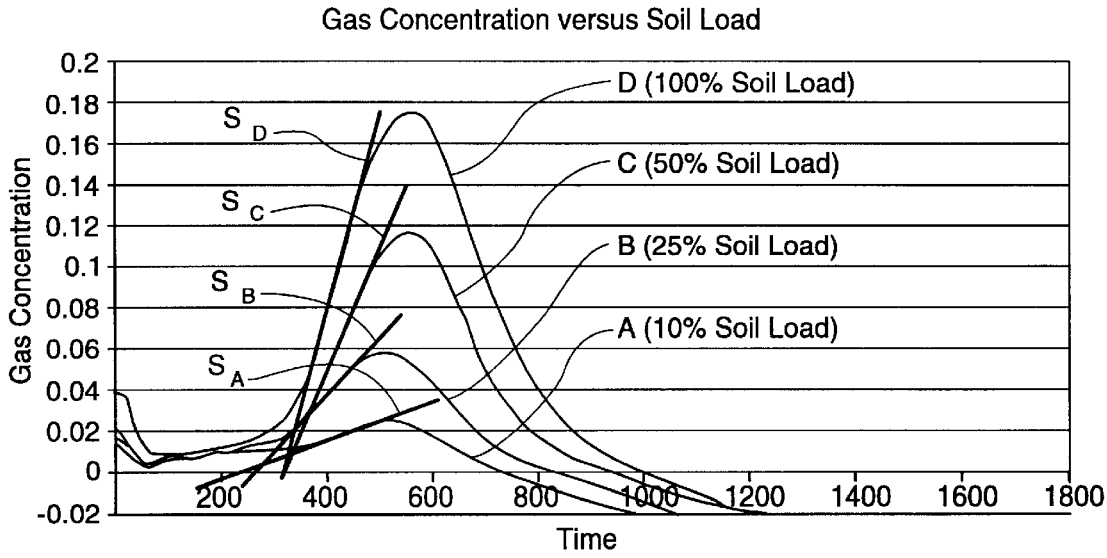
FIG. 9 is a graphic illustration for describing gas concentration level versus time curves which occur during a clean cycle for different soil loads in the oven and identifying slope values for the different curves at a predetermined period of time before the peak level has been achieved.
Figure 10:
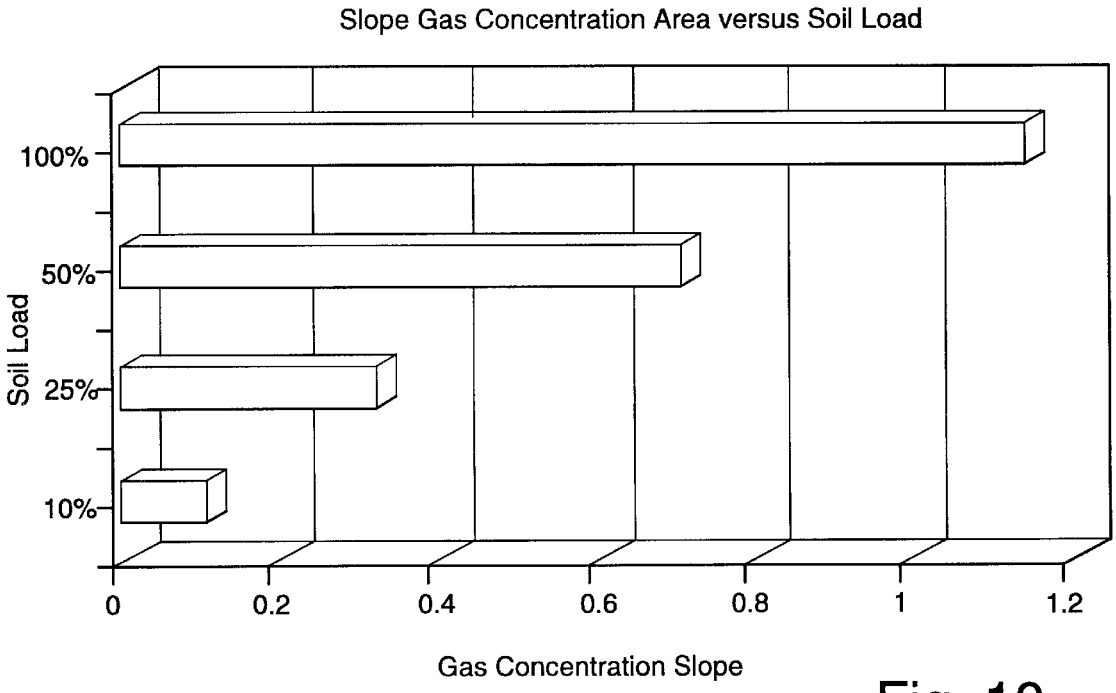
FIG. 10 is a chart illustrating the slope values for different soil load levels.

Yet another characteristic of the gas concentration curve that can be used to measure the degree of soiling in an oven is the rate of change or slope in the gas concentration curve during a predetermined period of time. FIG. 9 illustrates different gas concentration slope values $S_A$, $S_B$, $S_C$ and $S_D$ during a period of time when the gas concentration slope for the curves A, B, C and D, respectively. FIG. 10 illustrates the relationship between these gas concentration slope values and the soil load levels. The greater gas concentration slope values correspond to the greater soil loads.

Figure 11:
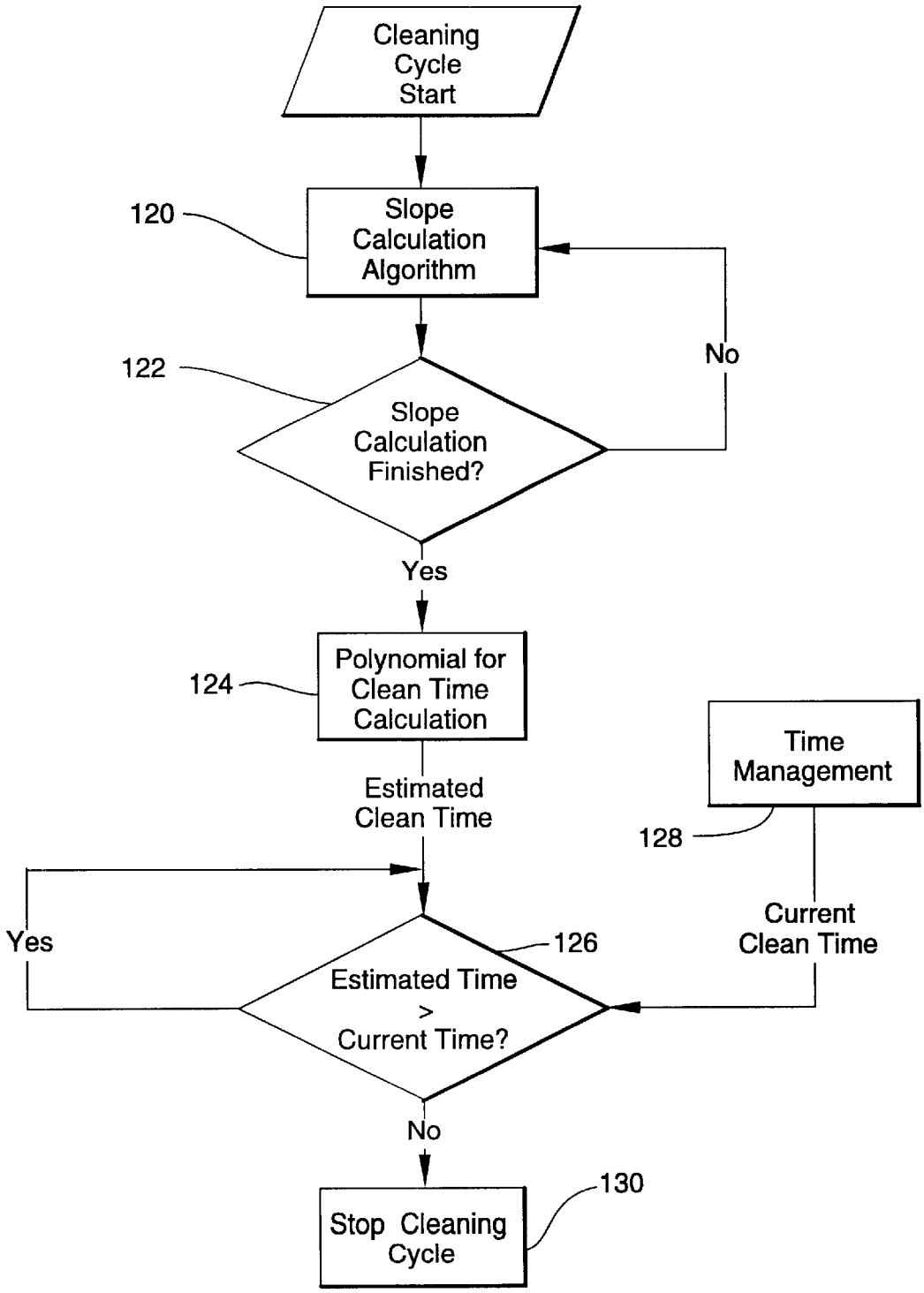
FIG. 11 is a flow chart for describing the oven cavity cleaning time logic which may be used in the present invention.

It can be seen, therefore, that the gas concentration slope values are a relatively good measure of the amount of food soils which have accumulated in the oven cavity. The greater the gas concentration slope values, the greater the soil load and the longer the self clean cycle must be to adequately clean the oven. Accordingly, this information may be used to control the length of the cleaning cycle. FIG. 11 is a flow chart illustrating how this information may be used to control the duration of a self clean cycle. After a clean cycle is selected, through an appropriate mode selector such as a knob or push button, the heating element 28 is energized to heat the oven cavity 24 to the appropriate clean temperature. The peak gas concentration value is then determined, as shown in steps 120 and 122. Once the peak concentration value has been measured, the clean time may be calculated as shown in step 124. The clean time is determined in accord with the following mathematical function:

$$\text{Cleantime}=\psi(\text{gas concentration slope value})$$

where $\psi$ is a mathematical function defined empirically via experiments.

The oven is then operated in a clean mode for the cleantime value calculated in step 124, as shown in steps 126 and 128. The clean cycle is terminated in step 130, after the calculated clean time has elapsed.

The duration of a self clean cycle, therefore, can be controlled to a minimum time through evaluation of the gas concentration curve or signature which is generated during a clean cycle. The area under the gas concentration curve in an optimized time range is a good indicator of the amount the soil load in the oven cavity, and can be used independently to set the proper duration for a self clean cycle. Moreover, the peak concentration value or the rate of change of the gas concentration curve may be used in combination with the gas concentration area value to even more precisely define the soil load such that the duration of the self clean cycle may be optimized.

In calculating the clean time, it may be beneficial to provide a baseline correction which includes a correction for base line drift due to temperature variations over time. One example of a correction parameter which may be calculated is:

$$\text{Cleantime}=\psi(\text{corrected average gas concentration})$$

where $$\text{corrected average gas concentration}=\text{SUM}(C(t_i))N-(C(T1)-C(T2))$$

C(ti) is the sample of gas concentration calculated at the $t_i$ moment of time; T1 is the beginning of the area measurements; T2 is the end of the measurements; SUM($C(t_i)$) is the sum of the concentration samples calculated between T1 and T2; and N is the number of samples between T1 and T2. The baseline correction is represented by (C(T1)−C(T2)). The correction for baseline drift is not meant to be part of the present invention.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. An oven capable of being operated in a self-cleaning cycle, comprising:

a cooking chamber;

a heating device for supplying heat into the cooking chamber;

an exhaust flue extending from the cooking chamber leading to atmosphere;

a heat control device for controlling the operation of the heating device;

an input device for signaling the heat control device to initiate the self-cleaning cycle;

a gas sensor communicating with the exhaust flue for measuring a concentration of a gas component produced from combustion of food soils within the cooking chamber and having a signal output indicative of the measured concentration of the gas component during the self-cleaning cycle; and the heat control device operable to receive successive gas concentration signals output from the gas sensor, to determine a gas concentration versus time curve, to calculate a gas concentration area representing the area under the gas concentration curve, and to terminate the self-cleaning cycle in correspondence with the gas concentration area.

2. The oven according to claim 1 wherein the heating device is an electric heating element.

3. The oven according to claim 1, wherein the heating device is a gas burner.

4. The oven according to claim 1 wherein the gas concentration area is calculated for a predetermined time range.

5. The oven according to claim 1, further comprising:

an outlet tube having an inlet end connected to the exhaust flue and having an outlet end; and a gas sensor located at the outlet end of the outlet tube for measuring gas concentration levels during the self-cleaning cycle.

6. An oven according to claim 5, wherein the outlet tube comprises a tube arranged at an upward angle from the inlet end to the outlet end.

7. An oven according to claim 5, wherein the outlet tube outlet is located in a console of the oven, remote from the cooking chamber.

8. An oven according to claim 1, wherein the heat device is further operable to determine the peak concentration value output from the gas sensor and to terminate the self-cleaning cycle in correspondence with both the gas concentration area and the peak concentration value.

9. An oven according to claim 1, wherein the heat device is further operable to receive successive gas concentration signals output from the gas sensor, to determine a gas concentration versus time curve, to calculate a gas concentration slope value for the gas concentration curve during a predetermined time and to terminate the self-cleaning cycle in correspondence with the gas concentration area and the gas concentration slope value.

10. An oven according to claim 1, wherein the heat device is further operable to receive successive gas concentration signals output from the gas sensor, to determine a gas concentration versus time curve, to calculate a gas concentration slope value for the gas concentration curve during a predetermined time and to terminate the self-cleaning cycle in correspondence with the gas concentration area, the peak concentration value and the gas concentration slope value.

11. The method of controlling the self-cleaning of a cooking oven cavity having an exhaust flue, comprising the steps of:

heating the interior of the oven cavity to a pyrolyzing temperature;

measuring the concentration of a gas component produced from combustion of food soils within the oven cavity by receiving successive gas concentration signals from a gas sensor communicating with the exhaust flue;

calculating a gas concentration versus time curve and then calculating a gas concentration area representing the area under the gas concentration curve; and terminating the heating of the oven cavity after a determined time which is correlated to the gas concentration area.

12. The method of controlling the self-cleaning of a cooking oven cavity according to claim 11, further comprising the step of:

calculating the gas concentration area for a predetermined time range.

13. The method of controlling the self cleaning cycle of a cooking oven cavity according to claim 11, further comprising the steps of:

determining a peak concentration value output from the gas sensor; and terminating the self-cleaning cycle in correspondence with both the gas concentration area and the peak concentration value.

14. The method of controlling the self cleaning cycle of a cooking oven cavity according to claim 11, further comprising the steps of:

calculating a gas concentration slope value for the gas concentration curve during a predetermined time; and terminating the self-cleaning cycle in correspondence with the gas concentration area and the gas concentration slope value.

15. The method of controlling the self cleaning cycle of a cooking oven cavity according to claim 13, further comprising the steps of:

calculating a gas concentration slope value for the gas concentration curve during a predetermined time; and terminating the self-cleaning cycle in correspondence with the gas concentration area, the gas concentration slope value and the peak concentration value.

* * * * *